US006706383B1

(12) United States Patent
Obeng et al.

(10) Patent No.: US 6,706,383 B1
(45) Date of Patent: Mar. 16, 2004

(54) POLISHING PAD SUPPORT THAT IMPROVES POLISHING PERFORMANCE AND LONGEVITY

(75) Inventors: Yaw S. Obeng, Orlando, FL (US); Peter A. Thomas, Orlando, FL (US)

(73) Assignee: PsiloQuest, Inc., Orlando, FL (US)

( * ) Notice: Subject to any disclaimer, the term of this patent is extended or adjusted under 35 U.S.C. 154(b) by 0 days.

(21) Appl. No.: 10/241,074

(22) Filed: Sep. 11, 2002

Related U.S. Application Data

(63) Continuation-in-part of application No. 09/994,407, filed on Nov. 27, 2001, now Pat. No. 6,579,604.

(51) Int. Cl.[7] ..... B32B 3/00; B32B 3/26

(52) U.S. Cl. ..... 428/314.2; 428/304.4; 428/314.4; 428/318.4; 428/319.3; 451/66; 451/113

(58) Field of Search ..... 451/66, 113, 259; 428/304.4, 308.4, 314.2, 314.4, 318.4, 319.3

(56) References Cited

U.S. PATENT DOCUMENTS

| | | | |
|---|---|---|---|
| 4,168,353 | A | 9/1979 | Kitamori |
| 5,578,362 | A | 11/1996 | Reinhardt et al. |
| 5,624,303 | A | 4/1997 | Robinson |
| 6,099,954 | A | 8/2000 | Urbanavage et al. |
| 6,267,644 | B1 | 7/2001 | Molnar |
| 6,283,829 | B1 | 9/2001 | Molnar |
| 6,291,349 | B1 | 9/2001 | Molnar |
| 6,293,851 | B1 | 9/2001 | Molnar |
| 6,300,386 | B1 | 10/2001 | Karukaya et al. |
| 6,328,634 | B1 | 12/2001 | Shen et al. |
| 6,346,202 | B1 | 2/2002 | Molnar |
| 6,354,915 | B1 | 3/2002 | James et al. |
| 6,413,153 | B1 | 7/2002 | Molar |
| 6,419,556 | B1 | 7/2002 | Urbanavage et al. |
| 6,425,803 | B1 | 7/2002 | Baker, III |
| 6,425,816 | B1 | 7/2002 | Roberts et al. |
| 6,428,388 | B2 | 8/2002 | Molnar |
| 6,435,948 | B1 | 8/2002 | Molnar |
| 6,585,574 | B1 | 7/2003 | Lombardo et al. ..... 451/285 |

FOREIGN PATENT DOCUMENTS

| | | |
|---|---|---|
| WO | WO 99/10129 | 3/1999 |

OTHER PUBLICATIONS

M.A. Rodriguez–Perez, A. Dujisens and J.A. De Saja; "Effect of Addition of EVA on the Technical Properties of Extruded Foam Profiles of Low–Density Polyethylene/EVA Blends"; Effects of Eva on Properties of LDPE/EVA Blends; Oct. 1997; pp. 1237–1244.

*Primary Examiner*—James J. Seidleck
*Assistant Examiner*—Travis B. Ribar

(57) ABSTRACT

The present invention provides, polishing pad with improved polishing properties and longevity. The pad is comprised of a thermoplastic foam substrate having a surface comprised of concave cells. A polishing agent coats an interior surface of the concave cells. The invention includes a method for preparing the polishing pad, and a polishing apparatus comprising the polishing pad.

18 Claims, 12 Drawing Sheets

(A)

(B)

POLISHING PAD SUPPORT THAT IMPROVES POLISHING PERFORMANCE AND LONGEVITY

CROSS-REFERENCE TO RELATED APPLICATIONS

This application is a continuation-in-part of U.S. patent application Ser. No. 09/994,407 entitled, "A METHOD OF ALTERING AND PRESERVING THE SURFACE PROPERTIES OF A POLISHING PAD AND SPECIFIC APPLICATIONS THEREFOR," to Yaw S. Obeng and Edward M. Yokley, filed on Nov. 27, 2001 now U.S. Pat. No. 6,579,604, which is commonly assigned with the present invention and incorporated herein by reference as if reproduced herein in its entirety.

TECHNICAL FIELD OF THE INVENTION

The present invention is directed to polishing pads used for creating a smooth, ultra-flat surface on such items as glass, semiconductors, dielectric/metal composites, magnetic mass storage media and integrated circuits. More specifically, the invention is directed to a pad comprised of a thermoplastic foam substrate and having a surface comprised of concave cells with a polishing agent coating the interior surface of the concave cells.

BACKGROUND OF THE INVENTION

Chemical-mechanical polishing (CMP) is used extensively as a planarizing technique in the manufacture of VLSI integrated circuits. It has potential for planarizing a variety of materials in IC processing but is used most widely for planarizing metallizied layers and interlevel dielectrics on semiconductor wafers, and for planarizing substrates for shallow trench isolation.

In shallow trench isolation (STI), for example, large areas of field oxide must be polished via to produce a planar starting wafer. Achieving acceptable planarization across the full diameter of a wafer using traditional etching processes has been largely unsuccessful. However, using conventional CMP, where the wafer is polished using a mechanical polishing wheel and a slurry of chemical etchant, unwanted oxide material is removed with a high degree of planarity.

Similarly, multilevel metallization processes, each level in the multilevel structure contributes to irregular topography. Planarizing interlevel dielectric layers, as the process proceeds, is often now favored in many state-of-the-art IC fabrication processes. High levels of planarity in the metal layers is a common objective, and this is promoted by using plug interlevel connections. A preferred approach to plug formation is to blanket deposit a thick metal layer, comprising, for example W, Ti, TiN, on the interlevel dielectric and into interlevel windows, and then removing the excess metal using CMP. CMP may also be used for polishing an oxide layers, such as $SiO_2$, $Ta_2O_5$ or $W_2O_5$ or to polish nitride layers such as $Si_3N_4$, TaN, TiN.

There are, however, several deficiencies in conventional polishing pad materials. Various types of materials, such as polyurethane, polycarbonate, nylon, polyureas, felt, or polyester, have poor inherent polishing ability, and hence are not used as polishing pads in their virgin state. In certain instances, mechanical or chemical texturing may transform these materials, thereby rendering them useful in polishing. Moreover, certain materials, such as polyurethane based pads, are decomposed by the chemically aggressive processing slurries by virtue of the inherent chemical nature of urethane. In turn, decomposition produces a surface modification in and of itself in the case of the polyurethane pads which may be detrimental to uniform polishing. In other instances, surface modification of materials used for CMP polishing pads may improve the application performance. Such modifications, however may be temporary, thus requiring frequency replacement or re-treatment of the CMP pad.

Accordingly, what is needed is an improved CMP pad capable of providing a highly planar surface during CMP and having improved longevity, while not experiencing the above-mentioned problems.

SUMMARY OF THE INVENTION

To address the above-discussed deficiencies, the present invention provides, in one embodiment, a polishing pad comprising a thermoplastic foam substrate having a surface comprised of concave cells and a polishing agent coating an interior surface of the concave cells. Another embodiment of the present invention is directed to a method for preparing a polishing pad. The method comprises the steps of providing a thermoplastic foam substrate, exposing cells with the substrate to form a surface comprising concave cells and coating an interior surface of concave cells with a polishing agent.

In yet another embodiment, the present invention provides a polishing apparatus. The apparatus comprises a mechanically driven carrier head, a polishing platen and a polishing pad. The carrier head is positionable against the polishing platen to impart a polishing force against the polishing platen. The polishing pad is attached to the polishing platen and includes a polishing body. The polishing body comprises a thermoplastic foam substrate having a surface comprised of concave cells and a polishing agent coating an interior surface of the concave cells.

The foregoing has outlined preferred and alternative features of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiments as a basis for designing or modifying other structures for carrying out the same purposes of the present invention. Those skilled in the art should also realize that such equivalent constructions do not depart from the scope of the invention.

BRIEF DESCRIPTION OF THE DRAWINGS

For a more complete understanding of the invention, reference is now made to the following descriptions taken in conjunction with the accompanying drawing, in which.

DETAILED DESCRIPTION

Figure 1:
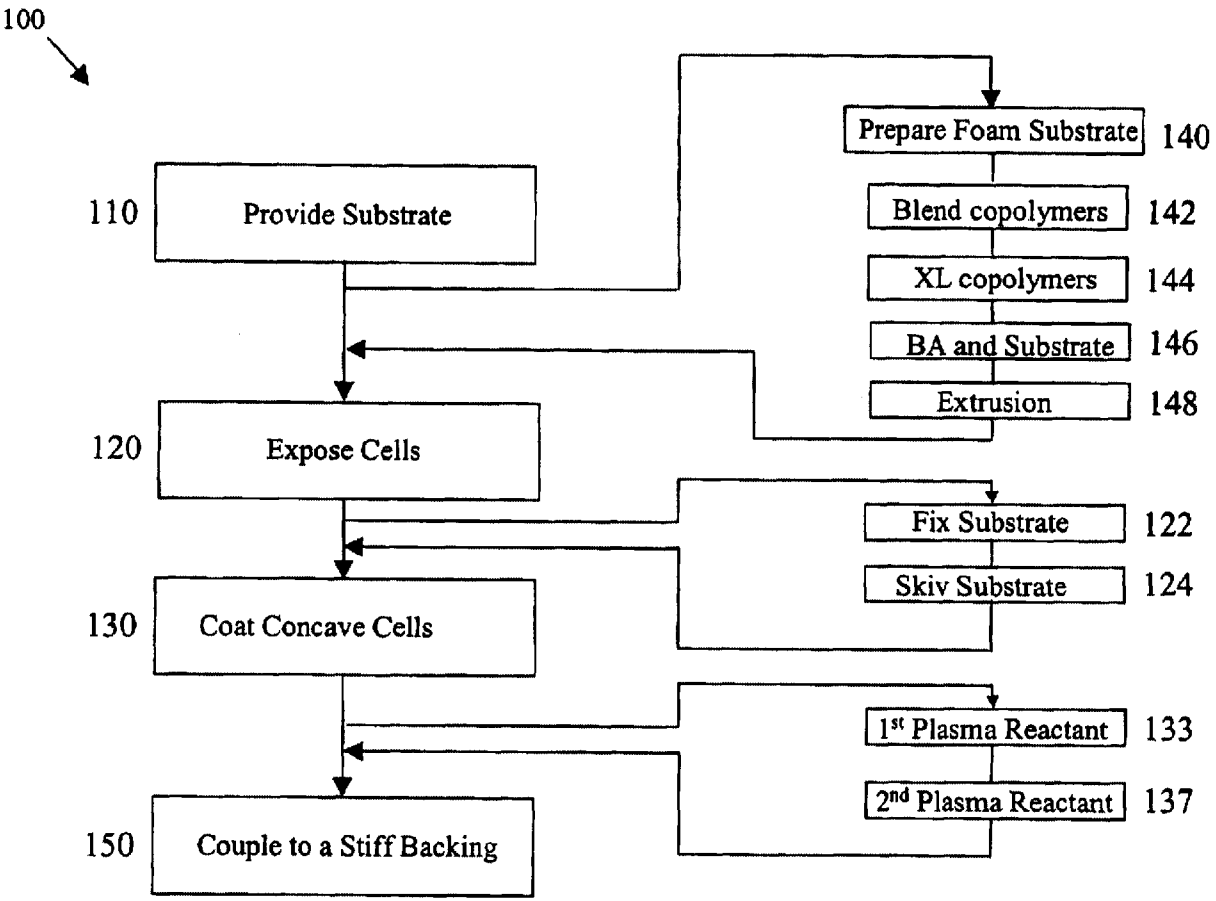
FIG. 1 illustrates, by flow diagram, a method for preparing a polishing pad of the present invention.

The present invention discloses a polishing pad that provides superior polishing performance over a longer working life, as compared to conventional pads. The present invention exploits the previously unrecognized advantages of using a thermoplastic polymer as the substrate for depositing a uniform coating of a polishing agent on concave cells formed on the substrate's surface by skiving. It has been discovered that the interior surface of the concave cells form excellent receptacles for receiving a uniform coating of the polishing agent. Though not limiting the scope of the present invention by theory, it is hypothesized that the center of the concave cell serves as an excellent nucleating point for coating because the surface energy of the cell at the center is lowest. It is believed that the initiation of coating at this location facilitates the uniform coverage of the interior surface of the concave cell with the polishing agent, thereby facilitating the polishing performance of a pad having such a surface.

The term skiving as used herein means any process to a cut away a thin layer of the surface of the substrate so as to expose concave cells within the thermoplastic foam substrate. Skiving may be achieved using any conventional technique well-know to one of ordinary skill in the art.

The term cell as used herein, refers to any volume defined by a membrane within the substrate occupied by air, or other gases used as blowing agents, defining a substantially concave cell formed upon skiving of the substrate. The concave cell need not have smooth or curved walls. Rather, as further illustrated in the Experimental section to follow, the concave cells may have irregular shapes and sizes. As further disclosed below, several factors, such as the composition of the substrate and the procedure used to prepare the foam substrate, may affect the shape and size of the concave cells.

One embodiment of the invention is directed to a polishing pad comprised of a thermoplastic foam substrate having a surface comprised of concave cells and a polishing agent coating an interior surface of the concave cells. In certain embodiments, the thermoplastic foam substrate may comprise cross-linked polyolefins, such as polyethylene, polypropylene, and combinations thereof. In certain preferred embodiments, the thermoplastic foam substrate is comprised of a closed-cell foam of crosslinked homopolymer or copolymers. Examples of closed-cell foam crosslinked homopolymers comprising polyethylene (PE) include: Volara™ and Volextra™ from Voltek (Lawrence, Mass.); Aliplast™, from JMS Plastics Supply, Inc. (Neptune, N.J.); or Senflex T-Cell™ (Rogers Corp., Rogers, Conn.). Examples of closed-cell foams of crosslinked copolymers comprising polyethylene and ethylene vinyl acetate (EVA) include: Volara™ and Volextra™ (from Voltek Corp.); Senflex EVA™ (from Rogers Corp.); and J-foam™ (from JMS Plastics JMS Plastics Supply, Inc.).

In other preferred embodiments, the closed-cell foam is comprised of a blend of crosslinked ethylene vinyl acetate copolymer and a low density polyethylene copolymer (i.e., preferably between about 0.1 and about 0.3 gm/cc). In yet other advantageous embodiments, the blend has a ethylene vinyl acetate:polyethylene weight ratio between about 1:9 and about 9:1. In certain preferred embodiments, the blend comprises EVA ranging from about 5 to about 45 wt %, preferably about 6 to about 25 wt % and more preferably about 12 to about 24 wt %. Such blends are thought to be conducive to the desirable production of concave cells having a small size as further discussed below. In still more preferred embodiments, the blend has a ethylene vinyl acetate:polyethylene weight ratio between about 0.6:9.4 and about 1.8:8.2. In even more preferred embodiments, the blend has a ethylene vinyl acetate:polyethylene weight ratio between about 0.6:9.4 and about 1.2:8.8.

In yet other advantageous embodiments, the thermoplastic foam substrate may be characterized as having at least about 85 wt % Xylene insoluble material. The process for measuring Xylene insoluble materials is well-known to those of ordinary skill in the art. Such processes may involve, for example, digestion of the blend in Xylene for 24 hours at 120° C. followed by drying and comparing the weight of the residual insoluble material to the predigestion material.

In certain embodiments, the thermoplastic foam substrate has cells formed throughout the substrate. In certain preferred embodiments, the cell are substantially spheroidal. In other preferred embodiments, the size of the cells are such that, on skiving the substrate, the open concave cells at the surface of the substrate have an average size between about 100 microns and 600 microns. The average size of the concave cells ranges from about 100 to about 350 microns, preferably about 100 to about 250 microns and more preferably about 115 to about 200 microns. Cell size may be determined using standard protocols, developed and published by the American Society for Testing and Materials (West Conshohocken, Pa.), for example, such as ASTM D3576, incorporated herein by reference.

In certain preferred embodiments, where the shape of the cell is substantially spherical, cell size is approximately equal to the mean cell diameter. In embodiments comprising EVA copolymer, for example, cell diameter is a function of the EVA content of co-polymer bend, as disclosed by Perez et al. J. Appl. Polymer Sci, vol. 68, 1998 pp 1237–1244, incorporated by reference herein. As disclosed by Perez et al. bulk density and cell density are inversely related. Thus, in other preferred embodiments, the density of concave cells at the surface of the substrate ranges between 2.5 and about 100 cells/mm$^2$, and more preferably, between about 60 and 100 cells/mm$^2$. Cell density may be determined, for example, from visual inspection of microscopic images of the substrate's surface.

The thermoplastic foam substrate may further comprise up to about 25 wt % of an inorganic filler material. The inorganic filler may be comprised of any Group I, Group II or Transition Metal well known to those of ordinary skill in the art to impart desirable translucence, color or lubricant properties to the foam substrate. For example, the inorganic filler may be selected from the group consisting of Talc, Titanium Oxides, Calcium Silicates, Calcium Carbonate, Magnesium Silicates, and Zinc salts. The thermoplastic foam substrate, in certain preferred embodiments, is comprised of about 17 wt % Talc. In other embodiments, the filler comprises silica (about 20 to about 25 wt %), zinc oxides (about 1 wt %), stearic acid (about 1 wt %), and other additives and pigments (up to about 2%) well known to those of ordinary skill in the art. Other conventional filler materials, such as that revealed in U.S. Pat. Nos. 6,425,816 and 6,425,803, incorporated by reference herein, are also within the scope of the present invention.

The thermoplastic foam substrate also desirably has certain mechanical properties to facilitate polishing. Specifically, the thermoplastic foam substrate must be capable of deforming during polishing to an extent sufficient to allow the polishing agent coating the interior surface of the concave cells to facilitate polishing. In certain embodiments, for example, the thermoplastic foam substrate has a Tensile Elongation between about 100% and about 800%. In certain preferred embodiments, Tensile Elongation is between about 100% and about 450%. In yet other embodiments, Tensile Elongation is between about 600% and about 800%. Tensile Elongation may be determined using standard protocols, such as ASTM D3575, incorporated herein by reference.

The polishing agent may comprise one or more ceramic compounds or one or more organic polymers, resulting from the grafting of the secondary reactants on the substrate's surface, as disclosed in obeng and Yokley, incorporated herein by reference. The ceramic polishing agents may comprise an inorganic metal oxide resulting when an oxygen-containing organometallic compound is used as the secondary reactant to produce a grafted surface. For example, the secondary plasma mixture may include a transition metal such as titanium, manganese, or tantalum. However, any metal element capable of forming a volatile organometallic compound, such as metal ester contain one or more oxygen atoms, and capable of being grafted to the polymer surface is suitable. Silicon may also be employed as the metal portion of the organometallic secondary plasma mixture. In these embodiments, the organic portion of the organometallic reagent may be an ester, acetate, or alkoxy fragment. In preferred embodiments, the polishing agent is selected from a group of ceramics consisting of Silicon Oxides and Titanium Oxides, such as Silicon Dioxide and Titanium Dioxide; Tetraethoxy Silane Polymer; and Titanium Alkoxide Polymer.

Numerous other secondary reactant may be used to produce the ceramic polishing agent, however. The secondary plasma reactant may include ozone, alkoxy silanes, water, ammonia, alcohols, mineral sprits or hydrogen peroxide. For example, in preferred embodiments, the secondary plasma reactant may be composed of titanium esters, tantalum alkoxides, including tantalum alkoxides wherein the alkoxide portion has 1–5 carbon atoms; manganese acetate solution in water; manganese alkoxide dissolved in mineral spirits; manganese acetate; manganese acetylacetonate; aluminum alkoxides; alkoxy aluminates; aluminum oxides; zirconium alkoxides, wherein the alkoxide has 1–5 carbon atoms; alkoxy zirconates; magnesium acetate; and magnesium acetylacetonate. Other embodiments are also contemplated for the secondary plasma reactant, for example, alkoxy silanes and ozone, alkoxy silanes and ammonia, titanium esters and water, titanium esters and alcohols, or titanium esters and ozone.

Alternatively, the polishing agent may comprise an organic polymers when organic compounds are used as the secondary plasma reactant. Examples of such secondary reactants include: allyl alcohols; allyl amines; allyl alkylamines, where the alkyl groups contain 1–8 carbon atoms; allyl ethers; secondary amines, where the alkyl groups contain 1–8 carbon; alkyl hydrazines, where the alkyl groups contain 1–8 carbon atoms; acrylic acid; methacrylic acid; acrylic acid esters containing 1–8 carbon atoms; methacrylic esters containing 1–8 carbon atoms; or vinyl pyridine, and vinyl esters, for example, vinyl acetate. In certain preferred embodiments, the polishing agent is selected from a group of polymers consisting of Polyalcohols and Polyamines.

In certain embodiments, the coating of polishing agents may advantageously alter the physical properties of the substrate comprising the polishing pad. In certain preferred embodiments, for example, the substrate, after being coated with an organic polymer polishing agent, has peak Tan Delta at least about 40° C. lower than the uncoated thermoplastic foam substrate. In other preferred embodiments, the peak loss modulus of the organic polymer coated substrate is at least about 10° C. lower than for the uncoated substrate. The peak Tan Delta and peak Loss Modulus may be determined using techniques, such as Dynamic Mechanical Analysis, well known to those of ordinary skill in the art.

Yet another embodiment of the present invention is a method for preparing a polishing pad. Turning to the flow diagram depicted in FIG. 1, the method 100 comprises the steps of providing a thermoplastic foam substrate 110, exposing cells 120 within the substrate to form a surface comprising concave cells and coating an interior surface 130 of the concave cells with a polishing agent.

In certain preferred embodiments, providing a foam substrate 110 includes preparing the substrate to include cells within the substrate by a foaming process 140. The size of the closed cells within the substrate affects the size of the concave cells ultimately formed on the surface of the substrate. Several factors affect the size of the closed cells. As noted elsewhere herein, for certain embodiments, the relative amounts of ethylene vinyl acetate copolymer and polyethylene may be controlled in order to advantageously adjust the size of cells produced during the foaming process. In addition, the kind of foaming process used may result in different cells sizes.

In certain embodiments, for example, providing the substrate 110 may include preparing the thermoplastic foam by a foaming process 140. Any process well know to those of ordinary skill in the art may be used. The process may include, for example, blending 142 the polymers comprising the substrate in a blender. The process 140 may also include crosslinking (XL) 144 polymers in the substrate, using irradiation or chemical means to achieve crosslinking. The process may further include forming a mixture of the substrate and a blowing agent (BA) 146, preferably under pressure, and extruding the mixture through a conventional die 148 to form sheets of closed-cell foams.

The process 110 used to provide the substrate preferably provides a closed-cell foam, which upon exposing of the cells 130, results in concave cells having an average size of between about 100 microns and about 600 microns and a cell density of at least about 4.5 cells/mm$^2$, and more preferably a size between about 100 microns and about 200 microns and a cell density of at least about 60 cells/mm$^2$.

Exposing cells 120to form a surface comprising concave cells may be achieved by any conventional process well known to those of ordinary skill in the art. For example, exposing 120 may be achieved by fixing 122 the thermoplastic foam substrate on a planar surface, and cutting 124 a thin layer (i.e., between about 1200 microns and about 2000 microns) from the surface of the substrate. In certain preferred embodiments, skiving or cutting 124 may be performed using a skiving device, such as a those provided by Fecken-Kirfel, (Aachen, Germany).

Coating the interior surface 130 can be achieved using the grafting procedure disclosed in U.S. application Ser. No. 09/994,407, incorporated herein by reference. Thus, in certain embodiments, coating may comprise exposing the interior surface to an initial plasma reactant (1st plasma reactant) 133 to produce a modified surface thereon. Coating 130 may further comprise exposing the modified surface to a secondary plasma reactant (2nd plasma reactant) 137 to create a grafted surface on the modified surface, the grafted surface comprising the polishing agent. Any of the primary and secondary reactants or procedures described in U.S. patent application Ser. No. 09/994,407 may be used in the grafting process to coat the polishing agent on the interior surface of the concave cells of the substrate of the present invention.

In certain alternative embodiments, the thermoplastic foam substrate is coupled 150 to a stiff backing material. A stiff backing limits the compressibility and elongation of the foam during polishing, which in turn, reduce erosion and dishing effects during metal polishing via CMP. In certain preferred embodiments, the stiff backing material is comprised of a high density polyethylene (i.e., greater than about 0.98 gm/cc), and more preferably condensed high density polyethylene. In certain embodiments coupling is achieved via chemical bonding using a conventional adhesive, such as epoxy or other materials well known to those skilled in the art. In other preferred embodiments coupling is achieved via extrusion coating of the molten backing material onto the foam, In still other embodiments the backing is thermally welded to the foam.

Figure 2:
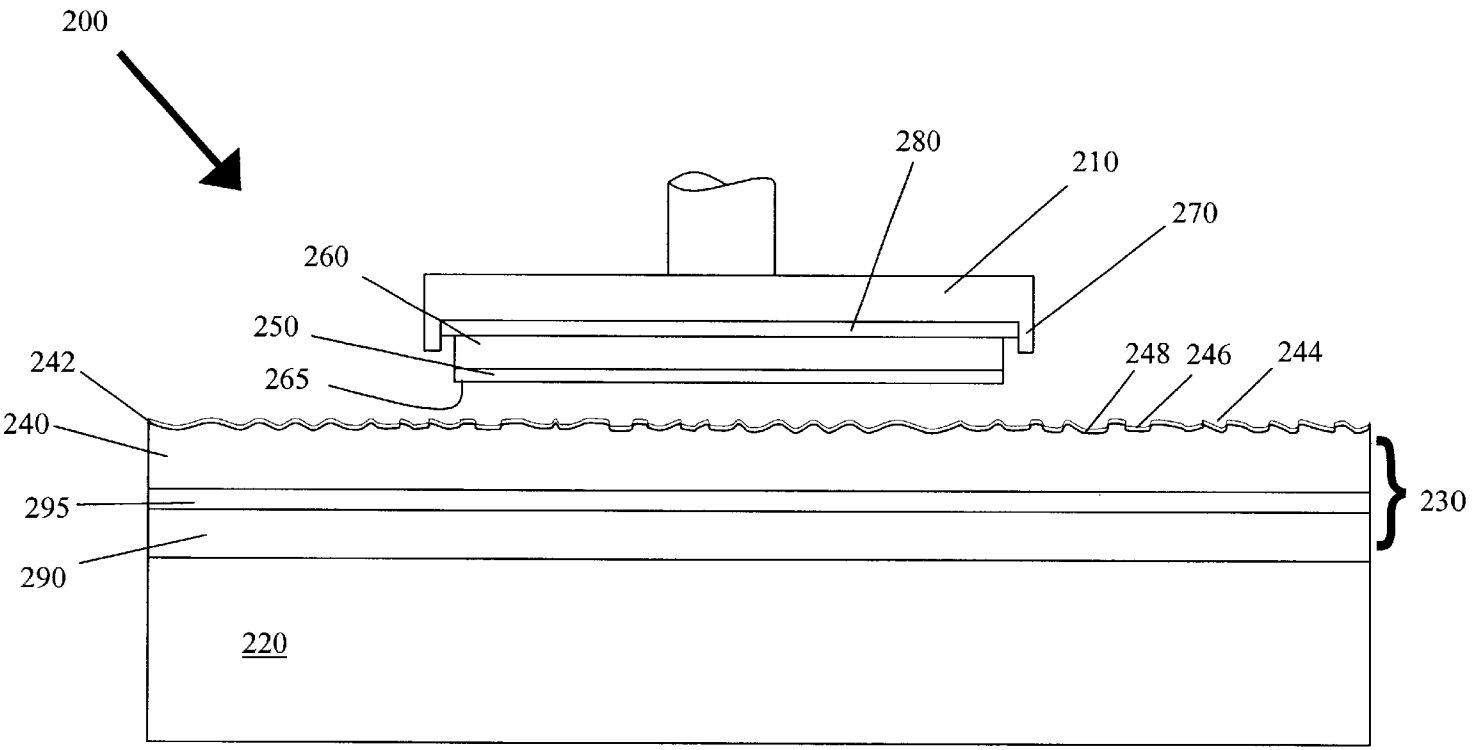
FIG. 2 illustrates a polishing apparatus, including a polishing pad fabricated using a thermoplastic foam polymer made according to the present invention.

Yet another embodiment of the present invention is a polishing apparatus. As illustrated in FIG. 2, the apparatus 200 is comprised of a mechanically driven carrier head 210, a polishing platen 220, the carrier head 210 being positionable against the polishing platen 220 to impart a polishing force against the polishing platen 220. The apparatus 200 further includes a polishing pad 230 attached to the polishing platen 220. The polishing pad 230 includes a thermoplastic foam substrate 240 having a surface 242 comprised of concave cells 244. The polishing body 230 further includes a polishing agent 246 coating the interior surface 248 of the concave cells 244.

In certain preferred embodiments, the polishing pad 230 is capable of polishing a metal 250 on a device substrate 260 surface 265 at a removal rate of at least about 40 Angstroms/second using a down force between about 26 and about 31 kPa, a table speed between about 60 and 100 rpm and a carrier speed between about 65 and about 105 rpm. Moreover, the removal rate may be attained in about 2 minutes cumulative polishing time and maintained for at least about 58 minutes cumulative polishing time. The term cumulative polishing time as used herein, refers to the total time the polishing pad 230 is used to successively polish multiple surfaces, such as the surface 265 of any number of the device substrates 260, such as semiconductor devices on a wafer.

In other preferred embodiments, the removal rate of the metal 250 during polishing of the device surface 265 remains within about ±20%. Moreover, the removal rate may attained in about 2 minutes cumulative polishing time and maintained for at least about 58 minutes cumulative polishing time. In still other preferred embodiments, the metal 250 is selected from the group consisting of copper and tungsten. In particular preferred embodiments, the metal 250 comprises tungsten, and the device surface 265, after polishing, has a defect density corresponding to less than about 125 counts/200 mm wafer using a down force of less than about 31 kPa and a table speed of at least about 75 ppm.

Additional embodiments of the apparatus 200 may include a conventional carrier ring and adhesive 280 to securely couple the substrate 260 to the carrier head 210. The polishing body 230 may further include a stiff backing material 290 coupled to the thermoplastic foam substrate 240, for example using a conventional second adhesive 295.

Having described the present invention, it is believed that the same will become even more apparent by reference to the following experiments. It will be appreciated that the experiments are presented solely for the purpose of illustration and should not be construed as limiting the invention. For example, although the experiments described below may be carried out in a laboratory setting, one skilled in the art could adjust specific numbers, dimensions and quantities up to appropriate values for a full-scale plant setting.

EXPERIMENTS

Experiments were conducted to: 1) examine the concave cells on the surface of the thermoplastic foam substrate; 2) characterize the chemical composition and mechanical properties of the foam substrate; and 3) measure the polishing properties of the polishing pads of the present invention under different polishing conditions and comparing their polishing properties to conventional pads.

Experiment 1

Scanning electron microscopic (SEM) images using conventional instrumentation and processes were obtained from skived thermoplastic closed-cell foam substrates of the present invention before and after coating a polishing agent on the interior surface of concave cells on the substrate's surface. In addition, conventional confocal fluorescence microscopic images of the coated substrate were obtained using conventional instrumentation and processes.

The thermoplastic foam was formed into approximately 120 cm by 142 cm area sheets of about 0.3 cm thickness. The commercially obtained thermoplastic foam substrate (J-foam from JMS Plastics, Neptune N.J.), designated as "J-60," comprised a blend of about 18% EVA, about 16 to about 20% talc, and balance polyethylene and other additives present in the commercially provided substrate. The J-60 sheets were skived with a commercial cutting blade (Model number D5100 K1, from Fecken-Kirfel, Aachen, Germany). The sheets were then manually cleaned with an aqueous/isopropyl alcohol solution.

To coat J-60 with polishing agent comprising silicon dioxide, the skived substrate was placed in the reaction chamber of a conventional commercial Radio Frequency Glow Discharge (RFGD) plasma reactor having a temperature controlled electrode configuration (Model PE-2; Advanced Energy Systems, Medford, N.Y.). The plasma treatment of the substrate was commenced by introducing the primary plasma reactant, Argon, for about 30 to about 120 seconds, depending on sample size and rotation speed, within the reaction chamber maintained at about 350 mTorr. The electrode temperature was maintained at about 30° C., and a RF operating power of about 100 to about 2500 Watts was used, depending on the sample and reaction chamber size. Subsequently, the secondary reactant was introduced for either 10 or 30 minutes at 0.10 SLM and consisted of silicon dioxide precursor, tetraorthosilicate (TEOS), mixed with He or Ar gas. The amount of precursor in the gas stream was governed by the vapor pressure (BP) of the secondary reactant monomer at the monomer reservoir temperature (MRT; 90±10° C.).

Figure 3:
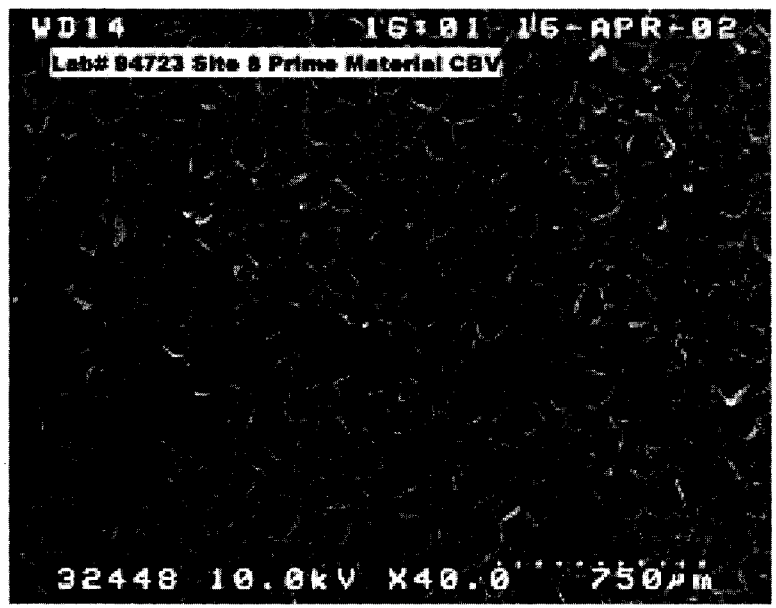
FIG. 3 illustrates scanning electron microscopy images of a surface of a thermoplastic foam substrate of the present invention: (A) after skiving to exposed concave cell, and (B) after coating the interior surface of the cells with a ceramic polishing agent comprising $SiO_2$.
Figure 3:
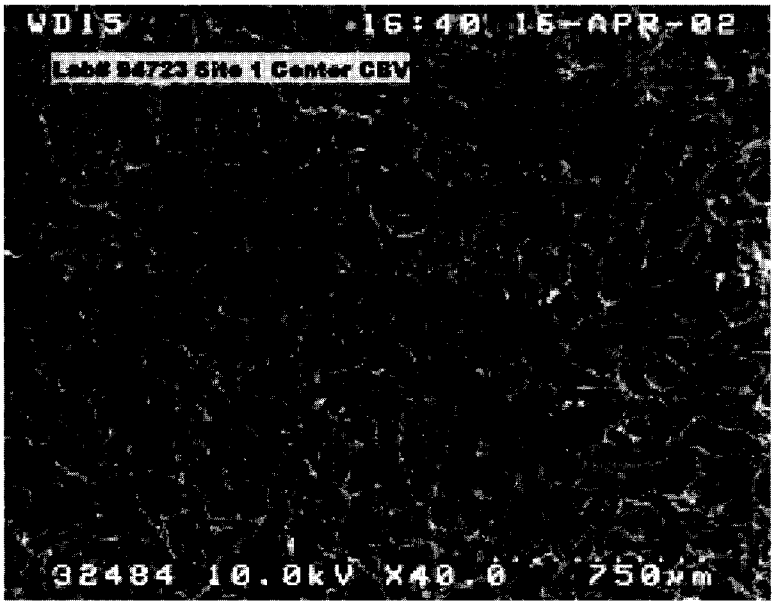

Illustrative examples of SEM Images at 40×magnification are presented in FIG. 3 for: (A) the substrate J-60 after skiving and (B) the substrate J-60 after skiving and coating with silicon dioxide. As depicted in both FIGS. 3A and 3B, the concave cells are substantially spheroidal, although elliptical and more irregular shapes are observed. Measurements of cell size revealed an average size of about 100 to about 125 microns. In addition, the density of cells per unit area of the surface was determined by visual inspection of SEM images for substrates containing different amounts of EVA. The cell density ranged from about 60 to about 100 cells/mm$^2$. There was no substantial change in the shape, size or density of the concave cells after coating.

Figure 4:
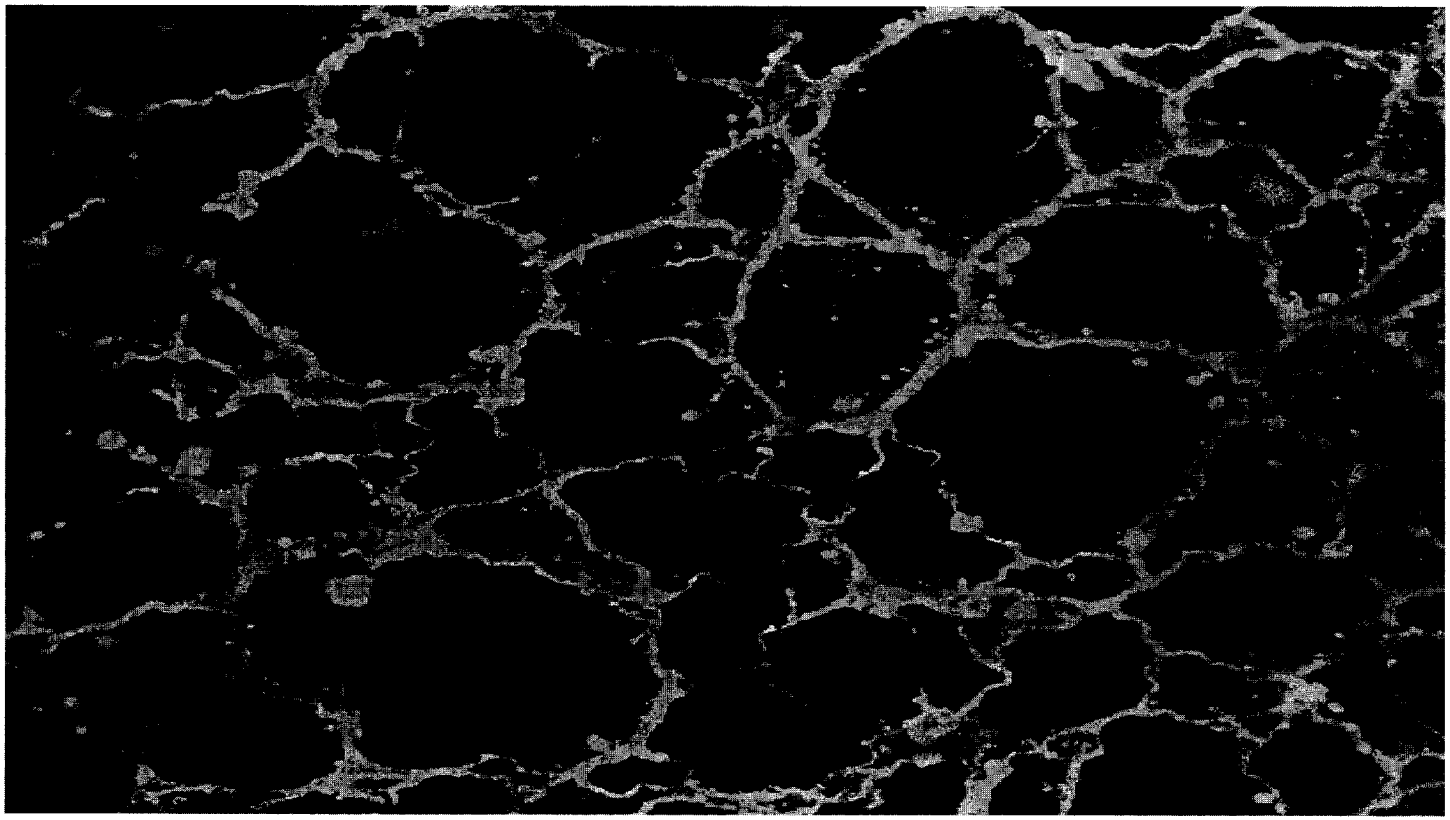
FIG. 4 illustrates a fluorescence microscopy image of a surface of a thermoplastic foam substrate of the present invention after skiving to expose concave cells and coating the interior surface of the cells with a ceramic polishing agent comprising $SiO_2$.

A representative fluorescence microscopic image of the J-60 substrate after coating with silicon dioxide is presented in FIG. 4. Hyper-intense regions outlining the edges of concave cells were assigned to fluorescence from the polishing agent and the thermoplastic substrate itself. Intense regions within the concave cells were assigned to polishing agent coating the cells. As illustrated in the figure the silicon dioxide coating agent uniformly coats the interior surface of the cells.

Experiment 2

The chemical composition and mechanical properties of several commercially available thermoplastic closed-cell foam substrates were compared. In addition to J-60, described in Experiment 1, the following thermoplastic foam substrates were examined: SV1A comprised a skived 0.070" medium density Polyethylene (PE) foam (Volextra™ from Voltek, Lawrence, Mass.) attached to backing of 0.040" thick condensed High Density Polyethylene (HDPE); SSV2 comprised a skived 0.070" medium density PE foam (Volextra™ from Voltek) attached to a backing of 0.040" thick condensed EVA-HDPE Copolymer; and SC12G comprised a skived 0.070" EVA-PE foam (Volextra™ from Voltek).

The chemical composition was assessed by subjecting weighed amounts of substrate to digestion in 100% Xylene for 24 hours at 120° C. followed by drying and comparing the weight percentage of the residual insoluble material remaining relative to the predigestion material(Xylene %). The weight percent of EVA (EVA %) blended with the polyethylene was obtained from the manufacturer. In addition, the weight percent of inorganic fillers (Filler %), comprising Talc, Titanium Oxides, Calcium Silicates, Calcium Carbonate, Magnesium Silicates, and Zinc salts was obtained from the manufacturer or assessed by conventional chemical analysis, such as Differential Scanning Calorimetry and Residue Analysis after total organic combustion. The chemical composition of the thermoplastic foam substrates is presented in TABLE 1.

TABLE 1

| Composition | J-60 | SV1A | SSV2 | SC12G |
|---|---|---|---|---|
| Xylene % | ~85.7 | ~30.8 | ~29.8 | n.m. |
| EVA % | ~6 to ~12 | ~0 | ~29.8 | ~18 |
| Filler % | ~10 to ~16 | ~10 | ~10 | ~10 |

n.m.: not measured

The characterization of the mechanical properties of the above-mentioned thermoplastic foam substrates included assessments of: Density; Compression Strength; Hardness; Tensile Strength and Tensile Yield or Tensile Elongation to Break; Melting Point, as determined by Differential Scanning Calorimetry; and Coefficient of Friction. Tensile Elongation was tested in two orientations: along a x-axis and along a y-axis, where the x-axis and y-axis differ by 90 degrees. The results of these tests are summarized in TABLE 2.

TABLE 2

| Property | J60 | SV1A | SSV2 | SC12G |
|---|---|---|---|---|
| Density (lbs/ft$^3$) | 8.5 | 21.5 | 17.4 | 11.8 |
| Compression Strength (lb/sq in) | | | | |
| @ 5% | 5.2 | 5.6 | 5.6 | 4.8 |
| @ 10% | 8.8 | 73.6 | 22.8 | 7.6 |
| @ 15% | 12.0 | 120.8 | 36.0 | 10.8 |
| @ 25% | 15.6 | 157.6 | 47.6 | 14.8 |
| Shore Hardness | | | | |
| (A Scale) | 21 | 72 | 48 | 28 |
| (OO Scale) | 68 | 92 | 85 | 69 |
| Tensile Strength (lbs/in$^2$) | | | | |
| Machine | 196 | 625 | 599 | 393 |
| X-machine | 196 | 419 | 443 | 319 |
| Tensile Elongation (%) | | | | |
| Machine | 304 | 237 | 472 | 506 |
| X-machine | 301 | 173 | 446 | 504 |
| DSC Melt Peak (° C.) | 76.5 | 106.5 | 90.0 | 84.5 |
| Coefficient of Friction (g/g) | | | | |
| Static | 0.59 | 0.23 | 0.45 | |
| Kinetic | 0.57 | 0.22 | 0.43 | |

The characterization of the mechanical properties of thermoplastic foam substrates of the present invention further included Dynamic Mechanical Analysis (DMA) of the substrates before (No Treatment) and after coating with a polishing agent. The DMA measurements were obtained using a model number DMA 2980 and analyzed using Universal V2.5H software (both instruments from TA Instruments, New Castle, Del.).

Figure 5:
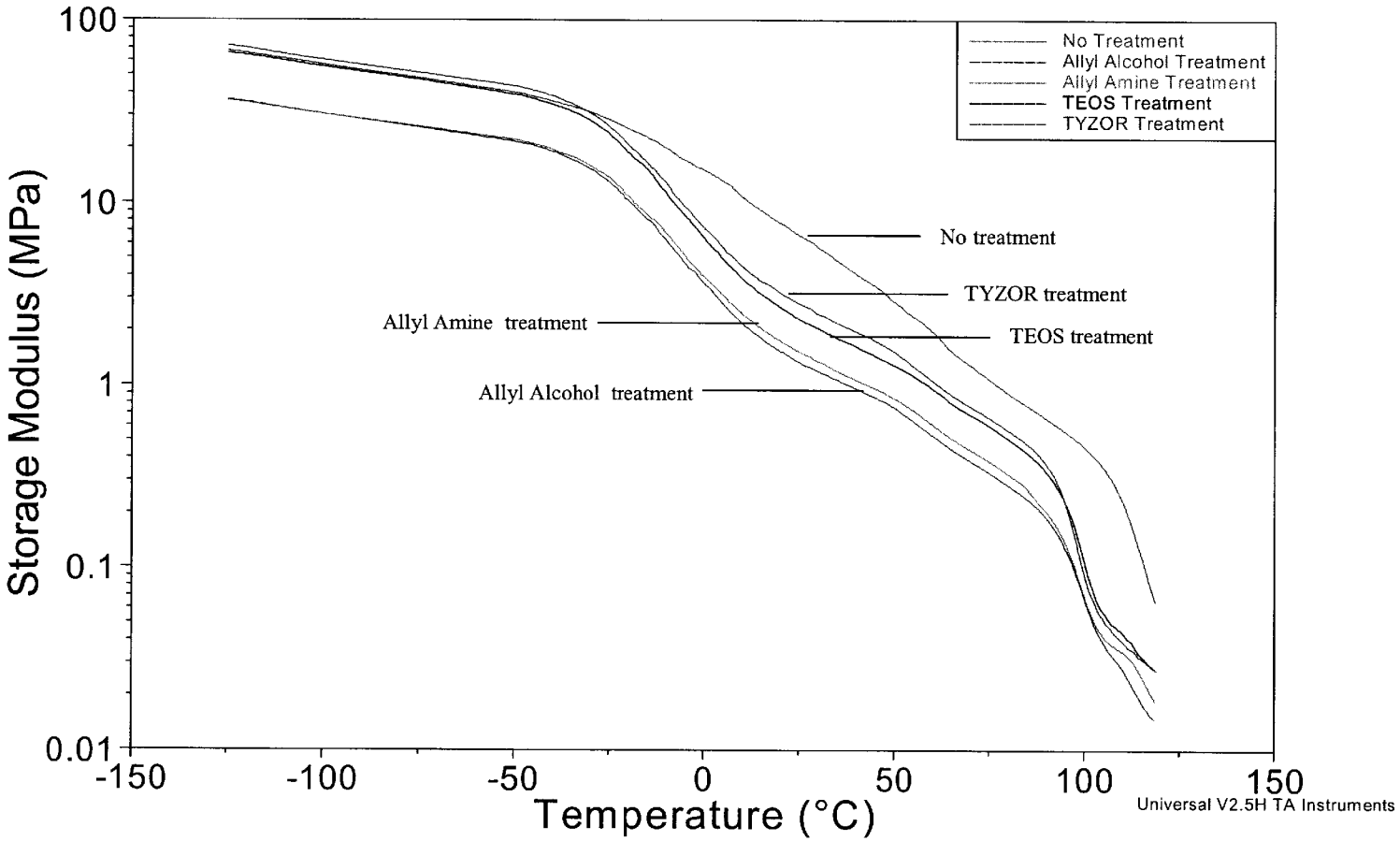
FIG. 5 illustrates the Dynamic Mechanical Analysis showing the relationship between Storage Modulus and Temperature for a thermoplastic foam substrate of the present invention (no treatment) and the same substrate after coating with various organic polishing agents.
Figure 6:
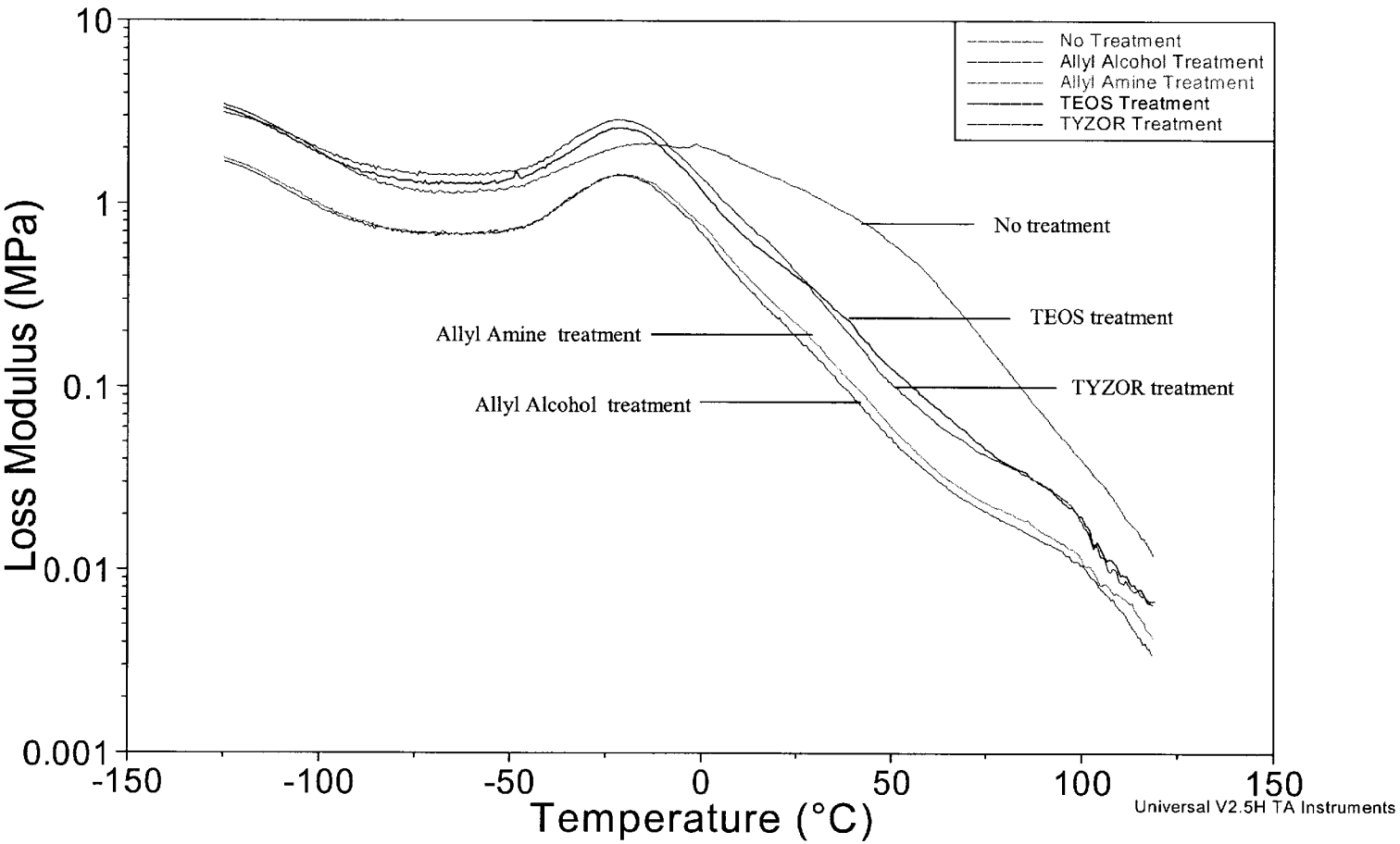
FIG. 6 illustrates the relationship between Loss Modulus and Temperature for a thermoplastic foam substrate of the present invention before coating (no treatment), and the same substrate after coating with various organic polishing agents.
Figure 7:
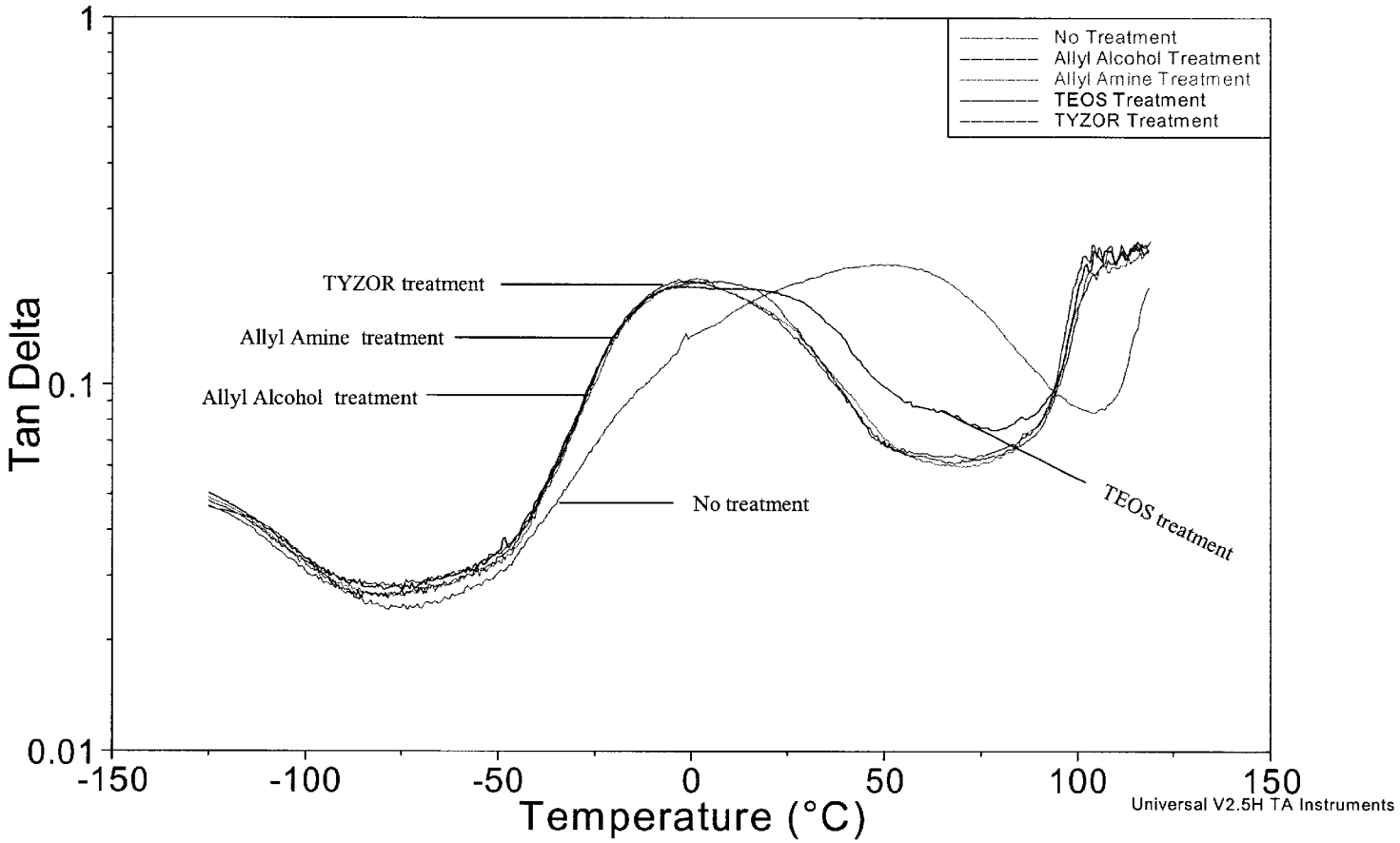
FIG. 7 illustrates the relationship between Tan Delta and Temperature for a thermoplastic foam substrate of the present invention before coating (no treatment), and the same substrate after coating with various organic polishing agents.

Exemplary data of Storage Modulus, Loss Modulus and Tan Delta are presented in FIGS. 5, 6 and 7, respectively. The polishing pad was coated with organic polymer polishing agents by exposing skived Aliplast® (JMS Plastic Supplies, Neptune, N.J.; Type 6A: medium foam density and hardness 34 Shore A), using the above-described grafting process. Secondary plasma reactants, containing either Allyl-Alcohol, or Allyl-Amine, Tetraethoxy Silane (TEOS), or tetraisopropyl-titanate(TYZOR TPT) monomers, were grafted onto the skived Aliplast® substrate, under conditions similar to that discussed in Experiment 1.

As illustrated in FIG. 6, of the coated substrate had a peak in Loss Modulus at about −20° C., while the uncoated substrate had a peak at about −10° C. Thus the peak loss modulus of the organic polymer coated substrate is at least about 10° C. lower than for the uncoated substrate. Similarly, as illustrated in FIG. 7, while the coated substrate has a peak Tan Delta at about 0 to 3° C., the uncoated substrate had a peak at about 50° C. Thus the peak Tan Delta of these organic polymer coated substrates are at least about 40° C. lower than for the uncoated substrate.

Experiment 3

The polishing properties of the polishing pads of the present invention were examined under different polishing conditions and compared to the polishing properties of conventional pads. To examine polishing properties under different polishing conditions, a polishing pad was prepared by exposing skived J60 thermoplastic foam substrates to the above-described grafting process to produce titanium dioxide and silicon dioxide coated polishing pads, designated as "J60TR" and "J60SR," respectively. Both of the J60TR and J60SR pads mechanically routed to afford slurry channels.

Tungsten polishing properties were assessed using a commercial polisher (Product No. EP0222 from Ebara Technologies, Sacramento, Calif.). Unless otherwise noted, the removal rate of tungsten polishing was assessed using a down force of about 13. N per inch$^2$ of substrate(about 3 to about 4 psi); table speed of about 100 to about 250 rpm and a conventional slurry (Product Number MSW2000, from Rodel, Newark Del.). Plasma Enhanced Tetraethylorthosilicate (PE-TEOS) about 10,000 Å thick wafers having a deposited about 8,000 Å tungsten surface and an underlying about 250 Å thick titanium barrier layer were used for test polishing.

The uniformity of tungsten removal across the wafer's surface was assessed using the same polishing apparatus and conditions. Contour plots of the tungsten surfaces polished using the J60TR and J60SR pads were measured electrically by measuring sheet resistance at 49 points distributed radially across the wafer. The average post-polishing depths of tungsten removed across the wafer, the standard deviation of the depth removed and the percent standard deviation of the depth removed (PostSTD %) were calculated from the 49 measured of sheet resistance. The PostSTD % was considered to be the best general indicator of the uniformity of the metal removal.

Figure 8:
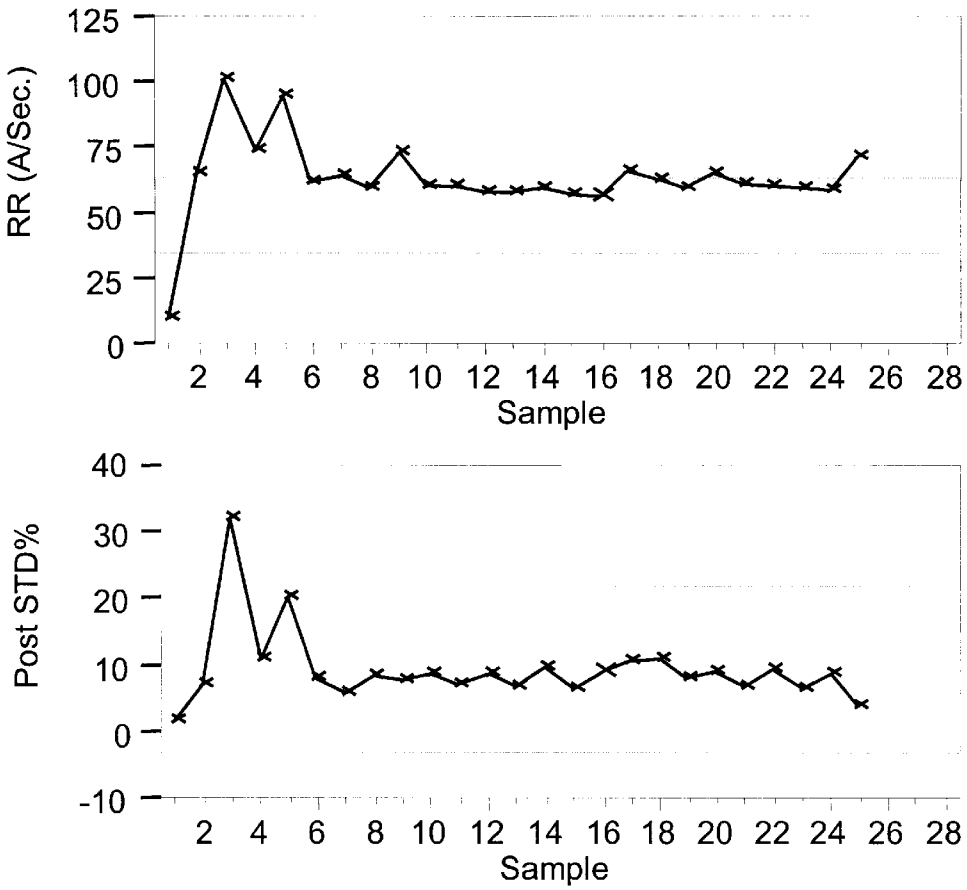
FIG. 8 illustrates: (A) the removal rate (RR) of tungsten from the surface of wafers, and (B) the uniformity of the surface of polished sample wafers (Post STD), after chemical mechanical polishing using a polishing pad of the present invention having a ceramic polishing agent comprising $TiO_2$.

FIGS. 8A and 8B illustrate, respectively, the tungsten removal rate (RR) and uniformity of tungsten removal (i.e., PostSTD %) obtained for multiple wafers (sample) polished using the J60TR pad. Importantly, the no preconditioning was performed on the pad prior to commencing the experiment. After polishing the first sample, the removal rate remained above at least about 60 Angstroms/sec, and uniformity of about 30% or better. Moreover, after the first five samples, the J60TR pad removed tungsten at a uniform rate (i.e., between about 60 and 75 Angstroms/sec) for at least 20 samples. Over this same period, the uniformity of tungsten removal across the wafer remained between about 8 and about 12%.

Figure 9:
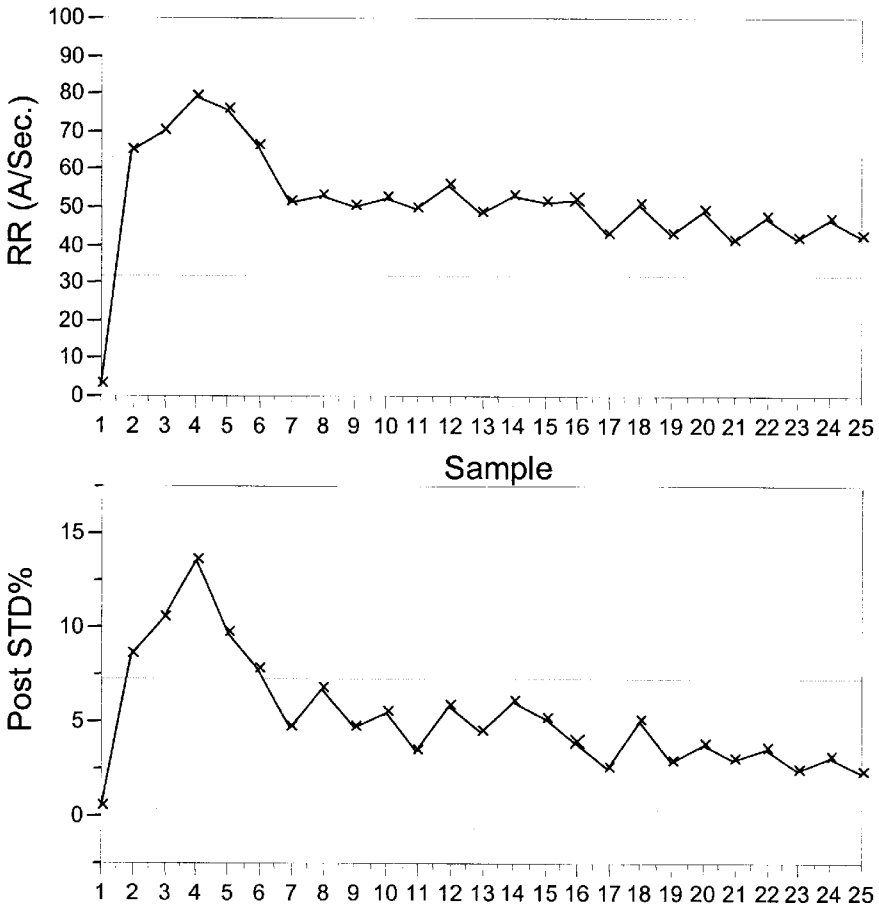
FIG. 9 illustrates: (A) the removal rate (RR) of tungsten from the surface of wafers, and (B) the uniformity of the surface of polished sample wafers (Post STD), after chemical mechanical polishing using a polishing pad of the present invention having a ceramic polishing agent comprising $SiO_2$.

As illustrated in FIGS. 9A and 9B, similar results were obtained using the J60SR polishing pad. Again, with no preconditioning, after polishing the first sample wafer, the tungsten removal rate remained at least about 40 Angstroms/sec, with a uniformity of about 14% or better. After the first five samples, the J60SR pad removed tungsten at a uniform rate (i.e., between about 40 and about 55 Angstroms/sec) for at least 20 samples. Over this same period, the uniformity of tungsten removal across the wafer remained between about 3 and 7%.

Figure 10:
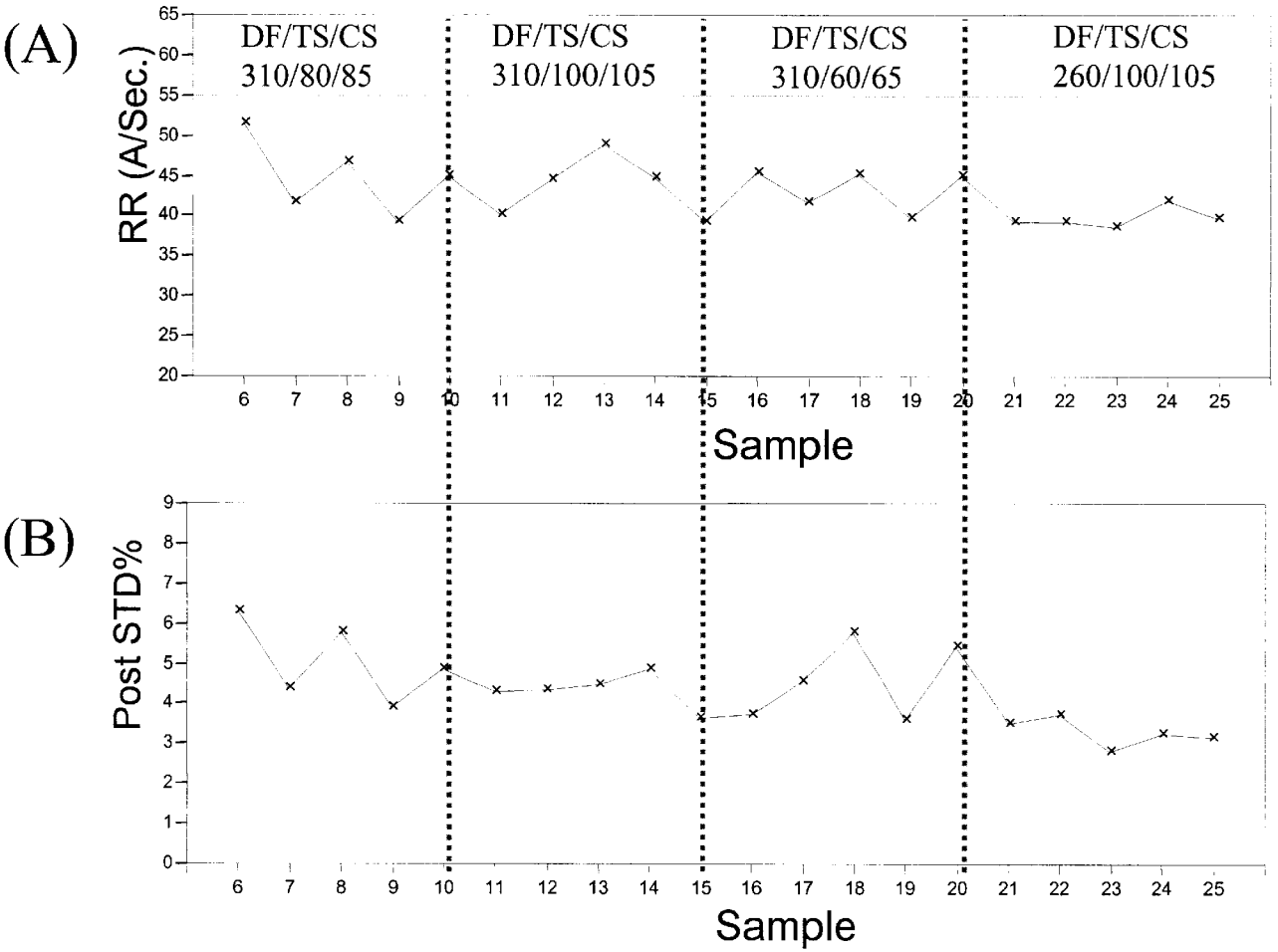
FIG. 10 illustrates the effect of down force, table speed and carrier speed on the (A) removal rate (RR) tungsten and (B) uniformity of the polished surface of a wafer (Post STD) using a polishing pad of the present invention having a ceramic polishing agent comprising $SiO_2$.

The effect of polishing conditions was assessed by examining the effect of varying the down force (DF), table speed (TF) and carrier speed (CS) on tungsten removal rate and the uniformity of removal. The results indicate that the pads of the present invention have acceptable polishing properties under a broad range of conditions. As illustrated in FIG. 10 for the J60SR pad, a removal rate of at least about 40 Angstroms/second using a down force between about 26 and about 31 kPa, a table speed between about 60 and 100 rpm and a carrier speed between about 65 and about 105 rpm. The uniformity of tungsten removal remained between about 2.8 and about 6.5%. The highest uniformity was obtained using a relatively low down force (i.e., about 26 kPa) and high table speed (i.e., about 100 rpm).

Figure 11:
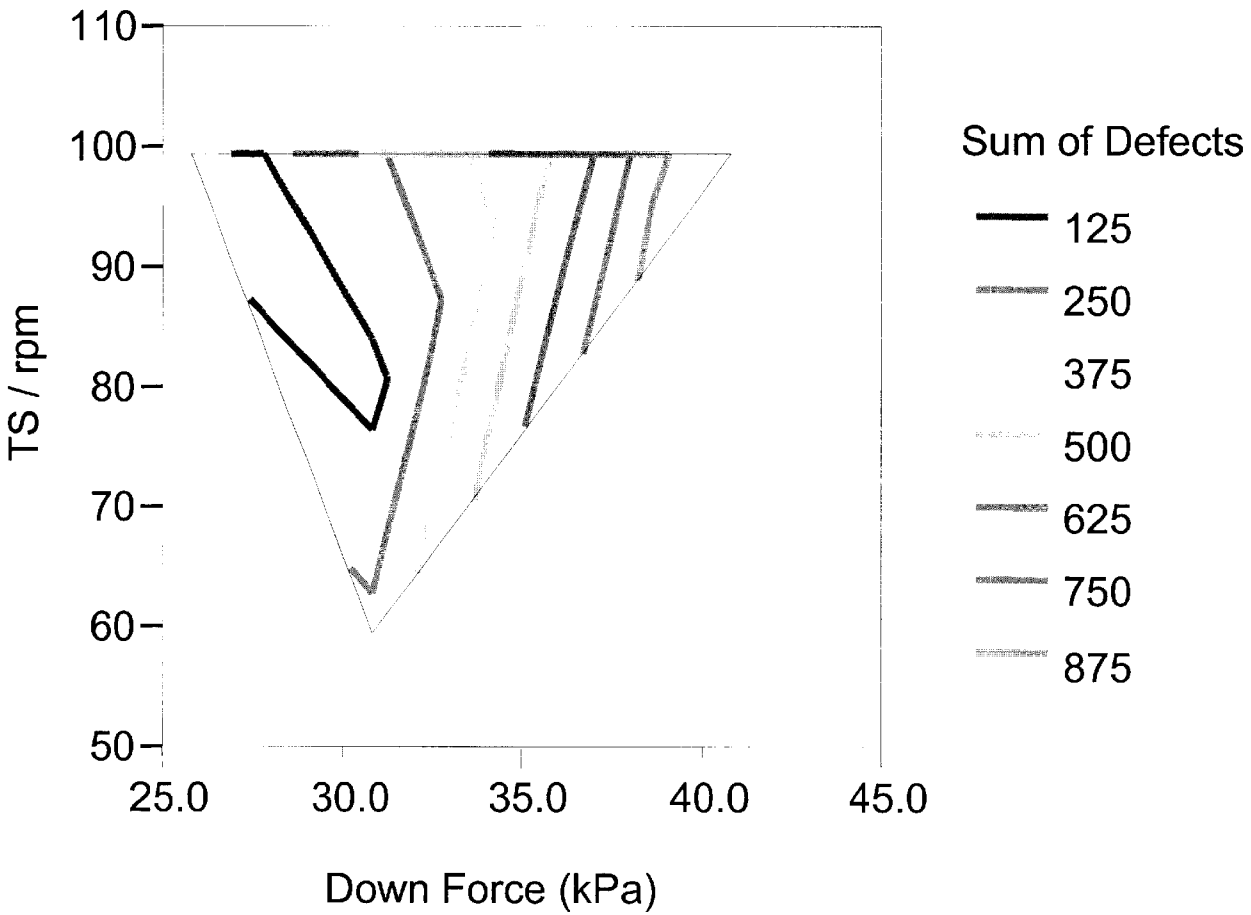
FIG. 11 illustrates the relationship between down force, table speed and defects on the polished surface of a wafer using a polishing pad of the present invention having a polishing agent comprising $SiO_2$.

The effect of polishing conditions was also assessed by examining the effect of varying the down force, table speed and carrier speed on slurry oxide polish defects. Post-polishing wafer defects were assessed using a KLA tencor SP-1 with a threshold of 0.2 microns. FIG. 11 illustrates the relationship between the number of defects and polishing conditions, down force and table speed, using a J60SR pad. The Sum of Defects in FIG. 11 refers to the cumulative counts of all light scattering events, regardless of the cause. The minimum number of defects were observed when using a combination of low down force (i.e., less than about 32 kPa) and high table speed (i.e., greater than about 75 rpm).

The polishing properties of the polishing pad of the present invention were compared to conventional pads. To compare to conventional pads, A polishing pad, designated as "SC4MS" was prepared using a thermoplastic foam substrate comprised of a polyethylene foam (medium density Volara™, from Voltek) capped from a 32 mil thick layer of High density polyethylene. To coat the substrate with a polishing agent comprising $SiO_2$ the secondary plasma reactant containing TEOS, was grafted onto the substrate, under conditions similar to that described in Experiment 1. The blanket Tungsten (W) polishing properties of the pad was compared to two a commercially available lots IC1000/SUBA IV pad stacks (Rodel, Newark Del.), designated IC1000/SUBA LOT-A and IC1000/SUBA LOT-B, respectively.

The comparison was performed using a commercial polisher (Product No. IPEC-472 from Speedfam-IPEC, Chandler Ariz.) and a conventional slurry comprising MSW2000 (Rodel, Newark Del.). Plasma Enhanced Tetraethylorthosilicate (PE-TEOS) about 5,000 Å wafers having a deposited about 8,000 Å tungsten surface used for test polishing.

Figure 12:
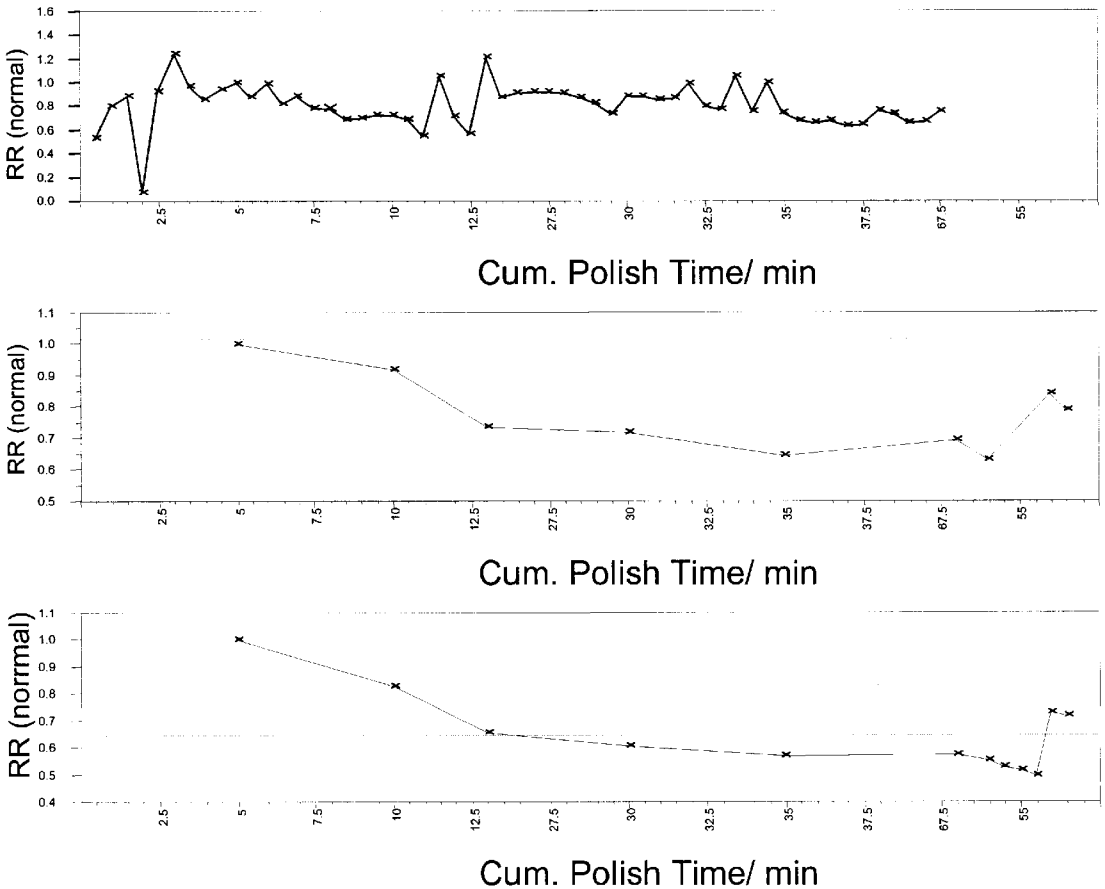
FIG. 12 illustrates a comparison of the normalized removal rate of tungsten from a wafer using A) a polishing pad of the present invention, and (B and C) two conventional polishing pads.

Tungsten removal rates for the SC4MS, IC1000/SUBA LOT-A and IC1000/SUBA LOT-B pads are illustrated in FIGS. 12A, 12B and 12C, respectively. To facilitate comparison of variations in removal rate during use, for the SC4MS pad, the removal rates are normalized (normal) with respect to the average removal rates obtained over the course of the experiment. Cumulative polishing time refers to the total time the polishing pad was used to successively polish a number of different wafer surfaces. For the SC4MS pad, after about 2 minutes cumulative polishing time the normalized removal rate remained within about ±20% for at least about 58 minutes cumulative polishing time. In contrast, the normalized removal rate of the IC1000/SUBA LOT-A and IC1000/SUBA LOT-B pads, progressively decreased from a normalized value of 1 at 5 minutes cumulative polishing time to as low as 0.6 by about 56 minutes cumulative polishing time.

Based on experiments such a that presented herein, two polishing pads are expected to have excellent tungsten and copper CMP properties. Both pads comprise a thermoplastic foam coupled to a ~32 mil thick backing of condensed HDPE. Coupling is achieved via extrusion coating of the molten HDPE on a prefabricated roll of foam. The thermoplastic foam is comprised of ~12 wt % talc, ~18 wt % EVA and balance PE and has a hardness of ~30 shore A. About ~9 percent of the thermoplastic foam's volume comprises cells. The foam is skived to provide a ~64 mil thick layer having a surface with opened cells. Pads for tungsten polishing have a ~500 micro thick layer of amorphous $SiO_2$ conformally coated to the concave surfaces of the open cells of the skived cells and therebetween. The $SiO_2$ is deposited by plasma enhanced chemical vapor deposition (CVD) using a metal ester precusor comprising tetraorthosilicate. Pads for copper polishing have a similar thickness layer of amorphous $TiO_2$ deposited by plasma enhanced CVD using a metal ester precursor comprising tetraorthotitinate.

Although the present invention has been described in detail, those skilled in the art should understand that they can make various changes, substitutions and alterations herein without departing from the scope of the invention.

What is claimed is:

1. A polishing pad comprising:

a thermoplastic foam substrate having a surface comprised of concave cells; and a polishing agent coating an interior surface of said concave cells;

wherein said thermoplastic foam substrate comprises a closed-cell foam comprising a blend of cross-linked ethylene vinyl acetate copolymer and a low or medium density polyethylene copolymer having a ethylene vinyl acetate:polyethylene ratio between about 0.6:9.4 and about 9:1.

2. The polishing pad as recited in claim 1 wherein said blend has a ethylene vinyl acetate copolymer:polyethylene ratio between about 0.6:9.4 and about 1.8:8.2.

3. The polishing pad as recited in claim 2 wherein said thermoplastic foam substrate has a Xylene-insolubles content of at least about 85 wt %.

4. The polishing pad as recited in claim 1 wherein said concave cells have an average size of between about 100 microns and 600 microns.

5. The polishing pad as recited in claim 1 wherein said polishing agent is selected from a group of ceramics consisting of:

Silicon Oxides;

Titanium Oxides;

Tetraethoxy Silane Polymer; and

Titanium Alkoxide Polymer.

6. The polishing pad as recited in claim 1 wherein said polishing agent is selected from a group of polymers consisting of:

Polyalcohols; and

Polyamines.

7. The polishing pad as recited in claim 6 wherein said substrate after being coated with any one of said polymers has peak Tan Delta at least about 40° C. lower than a substrate.

8. A method for preparing a polishing pad of claim 1 comprising:

providing a thermoplastic foam substrate;

exposing cells within said substrate to form a surface comprising concave cells; and coating an interior surface of said concave cells with a polishing agent.

9. The method as recited in claim 8 wherein said coating includes:

exposing said interior surface to an initial plasma reactant to produce a modified surface thereon; and exposing said modified surface to a secondary plasma reactant to create a grafted surface on said modified surface, said grafted surface comprised of said polishing agent.

10. The method as recited in claim 8 wherein said concave cells have an average size of between about 100 microns and about 600 microns and a cell density of at least about 4.5 cells/$mm^2$.

11. The method as recited in claim 8 wherein said providing said substrate includes preparing said thermoplastic foam substrate by a bonding process.

12. The method as recited in claim 8 wherein said thermoplastic foam substrate is coupled to a backing material comprised of high density polyethylene.

13. The method as recited in claim 12 wherein said backing is a condensed high density polyethylene.

14. A polishing apparatus comprising:

a mechanically driven carrier head;

a polishing platen, said carrier head being positionable against said polishing platen to impart a polishing force against said polishing platen; and a polishing body attached to said polishing platen and including a polishing body according to claim 1.

15. The polishing apparatus as recited in claim 14 wherein said polishing pad is capable of polishing a metal from a semiconductor surface at a removal rate of at least about 40 Angstroms/second using a down force between about 26 and about 31 kPa, a table speed between about 60 and 100 rpm and a carrier speed between about 65 and about 105 rpm, said removal rate being attained in about 2 minutes cumulative polishing time and maintained for at least about 58 minutes cumulative polishing time.

16. The polishing apparatus as recited in claim 15 wherein said removal rate of said metal during polishing of said semiconductor surface remains within about ±20%, said removal rate being attained in less than about 3 minutes cumulative polishing time and maintained for at least about 58 minutes cumulative polishing time.

17. The polishing apparatus as recited in claim 15 wherein said metal is selected from the group consisting of copper and tungsten.

18. The polishing apparatus as recited in claim 15 wherein said metal comprises tungsten and said semiconductor surface has defects corresponding to less than about 125 counts/200 mm wafer, where said down force is less than about 100 Angstroms/second and said table speed is at least about 75 rpm.

* * * * *

UNITED STATES PATENT AND TRADEMARK OFFICE

CERTIFICATE OF CORRECTION

PATENT NO. : 6,706,383 B1 
DATED : March 16, 2004
INVENTOR(S) : Yaw S. Obeng and Peter A. Thomas It is certified that error appears in the above-identified patent and that said Letters Patent is hereby corrected as shown below:

Column 14,
Lines 60-65, claim 18 should appear as follows:
18. The polishing apparatus as recited in claim 15 wherein said metal comprises tungsten and said semiconductior surface has defects corresponding to less than about 125 counts/200 mm wafer, where said down force is less about 31 kPa and said table speed is at least about 75 rpm.

Signed and Sealed this

Twenty-first Day of June, 2005

JON W. DUDAS
*Director of the United States Patent and Trademark Office*